US006652430B2

(12) United States Patent
Lapcevic

(10) Patent No.: US 6,652,430 B2
(45) Date of Patent: Nov. 25, 2003

(54) TRAINING DEVICE DESIGNED TO IMPROVE THE PHYSICAL READINESS LEVEL OF THE LOW BACK AND PELVIC GIRDLE

(76) Inventor: Paul S. Lapcevic, 39 Summit Point, Scenery Hill, PA (US) 15360

( * ) Notice: Subject to any disclaimer, the term of this patent is extended or adjusted under 35 U.S.C. 154(b) by 414 days.

(21) Appl. No.: 09/791,321

(22) Filed: Feb. 22, 2001

(65) Prior Publication Data

US 2001/0053734 A1 Dec. 20, 2001

Related U.S. Application Data

(60) Provisional application No. 60/184,905, filed on Feb. 25, 2000.

(51) Int. Cl.[7] ..... A63B 21/00
(52) U.S. Cl. ..... 482/134; 482/133; 482/136
(58) Field of Search ..... 482/92, 93, 94, 482/97–103, 133–138; 601/23, 24

(56) References Cited

U.S. PATENT DOCUMENTS 4,776,587 A * 10/1988 Carlson et al. ..... 482/134
5,088,727 A * 2/1992 Jones ..... 601/24
6,004,246 A * 12/1999 Sencil ..... 482/96

* cited by examiner

*Primary Examiner*—Glenn E. Richman
(74) *Attorney, Agent, or Firm*—James Ray & Associates

(57) ABSTRACT

A training apparatus designed to improve the physical readiness level of the low back and pelvic girdle of an individual includes a frame, a seat, a pivot mechanism mounted on the frame and providing a pivot point, an exercise arm rotatable about the pivot point, and a resistance assembly rotatable about the pivot point. An interlocking mechanism interlocks the exercise arm and the resistance assembly such that they rotate as a single unit about the pivot point of the pivot mechanism. The angle between the exercise arm and the resistance assembly is selectable. The resistance assembly includes at least a first resistance lever arm and, preferably, a second resistance lever arm. The first resistance lever arm includes a counterweight. The second resistance lever arm has a weight attachment mechanism for attaching a stress weight thereto, and the second resistance lever arm is angularly offset from the first resistance lever arm by an angle about the pivot point of the pivot mechanism.

27 Claims, 9 Drawing Sheets

TRAINING DEVICE DESIGNED TO IMPROVE THE PHYSICAL READINESS LEVEL OF THE LOW BACK AND PELVIC GIRDLE

CROSS-REFERENCE TO RELATED APPLICATIONS

This application claims the benefit of U.S. Provisional Application Serial No. 60/184,905, filed on Feb. 25, 2000 and titled "Exercise Device for Strengthening the Lower Back Area".

FIELD OF THE INVENTION

The present invention relates generally to devices employed for the rehabilitation and/or strengthening of the lower back area (i.e., the "pelvic girdle" region and/or "lumbar" region) of an individual. More particularly, the invention relates to devices that utilize progressive resistance training to rehabilitate and or strengthen the pelvic girdle/lumbar region of an individual.

BACKGROUND OF THE INVENTION

The following background information is provided to assist the reader to understand the invention described and claimed herein. Accordingly, any terms used herein are not intended to be limited to any particular narrow interpretation unless specifically so indicated.

Back and neck pain is one of the most widespread and troublesome of human maladies, and one that is frequently of a chronic nature. Of the total population, an extremely high proportion experience some form of back or neck pain at some time in their lives. For example, in Advances in Therapy, Volume 15, No. 3, May/June 1998, it is stated that, "[Lower Back Pain] is the leading cause of disability in people younger than 45, [and] is the second most prominent cause of industrial absenteeism, affecting up to 60% of all employees at some time in their careers. In 1990, costs associated with [lower back pain] were more than $50 billion in the United States alone. That year, workers' compensation costs for [lower back pain] exceeded $11 billion and have been rising steadily each year." For some, pain reaches debilitating levels.

It is widely believed that a relatively large proportion of back pain is due to the shifting and/or bulging of the spinal discs that are located between consecutive spinal column segments. These discs can become misaligned by shifting toward the front of the patient ("anterior"), toward the back of the patient ("posterior") or toward either side of the patient ("lateral"). Frequently, the aim of therapy is to bring a particular disc or discs back into proper alignment with the spinal column segments between which it is located. Thus, the spinal column has often been subjected to some type of elongating force, in order to relieve the pressure between the spinal segments and allow the misaligned and/or bulging disc(s) to return to proper alignment.

Various apparatuses have been devised for the non-surgical treatment through spinal manipulation, including spinal elongation. A number of such apparatuses are discussed immediately below. In general, such apparatuses can be subdivided into "active" vs. "passive". In a passive device, the spinal column of the patient is subjected to forces, and in fact some movement, however slight, while the patient remains essentially passive, i.e., exerting no muscular forces. In contrast, when using an active device, the patient performs movements, generally against some resistive force. As pointed out below, it is believed that the active form of therapy, particularly a progressive resistance form of training, has particular benefits over the passive type of therapy. In active therapy, the activation of all of the physiology within and surrounding the pelvic girdle region of the patient is activated, resulting in improved circulation that removes toxins from and carries nutrients to the activated physiology. In addition, a progressive resistance form of training is vitally needed to restore integrity of soft tissue (e.g., ligamentous structures, muscles, tendons, and capsules) of which the ligamentous structure in the pelvic girdle and lumbar area is very pronounced.

Such apparatuses can also be generally subdivided between "linear" vs. "curvilinear" (i.e., non-linear) devices. In a linear device, the spinal column of the patient is subjected to tensile forces acting essentially in a straight line along the axis of the spinal column. In contrast, in the use of a curvilinear device, the spinal column of the patient is subjected to a bending moment. Several advantages of curvilinear/non-linear motion are discussed in the article "Non-Linear Spinal Disc Traction-Medical Sciences' Ultimate Answer to One of Humanities Oldest Problems", which appeared in the December , 1999 issue of California Journal of Alternative Medicine. This article discusses how curvilinear motion can produce sufficient negative pressures in the spinal column (i.e., "intradiscal pressures") to literally "suck" the "nucleus pulposus" back into the torn annulus fibrosis. This reduces disc bulge, herniation, and surgical intervention.

DESCRIPTION OF THE RELATED ART

A device generally referred to by its tradename of "Medex" is designed with the belief that back pain could be cured by isolating very specific muscles of the lower back in a resistance training program. Thus, the Medex provides a locking mechanism to keep the femur and hip axis of the individual from moving forward or backward with adjustable pads, one pad being located in the lumbar region and the other, a pressure pad, that forces the femur back against the lumbar pad. The Medex also employs an adjustable belt, which holds the user against the seat with pressure applied high up on the thighs. When locked in this position, the individual has to perform a torso extension motion against a backrest that is connected to adjustable resistance weights. However, the Medex, by locking the individual into a rigid position, does not involve a synergistic activity of related soft tissue or decompression at various vertebral joints. Moreover, it does not provide opportunities for the development of a multitude of new recruitment pathways. The term "new recruitment pathways", as used herein, refers to the means by which selected muscle cells are activated. For example, in a particular movement, motor units are selected for use depending on the relative location of stress in the movement.

A device generally referred to by its tradename of "Vivatek" uses a table in which the patient lies, face up, in a completely horizontal position with his/her back against the tabletop. While the patient is in a passive mode, the device is electronically controlled to provide a lifting action (i.e., through the elevation of various portions of the table's upper surface) at a variety of locations along the vertebral column of the patient. The time interval of the elevated position and the frequency of the application of the lift are controlled electronically. During this passive mechanical manipulation of the spinal column, electronic controlled pulses, similar to sonar, are generated and projected through the lifting mechanism. These pulses are intended to stimulate better blood flow during the spinal manipulation. However, the Vivatek is passive in nature. Therefore, the patient does not have the additional benefit of muscular activity and the associated improvement in transportation of toxins from the soft tissue and transportation of nutrients to the soft tissue. Additionally, the patient is not involved in progressive resistance training.

However, the "Vivatek device", which is presumed by many to effect spinal decompression, has been significantly recognized in the industry, for example, by being awarded the 1998 "Therapeutic Product of the Year Award" by the World Health News Network. The present invention is believed to also perform spinal decompression, but with an apparatus which is significantly less expensive to manufacture.

An apparatus generally referred to by its tradename of "Vax-D" employs a table, upon which the patient assumes a prone, face down, position. The treatment provides a linear decompression of the spine by having the patient reach out, with both arms, and hold on to two vertical non-moveable posts. A harness is attached to the hip area of the patient and connected to a mechanical traction device. This traction device is electronically controlled as to the magnitude of force, the duration of the force, and the frequency of the force applied. Like the Vivatek device discussed above, the Vax-D apparatus is passive in nature. Therefore, the patient does not experience the benefit of muscular activity and its associated improvements in transportation of toxins from the soft tissue and transportation of nutrients to the soft tissue. Additionally, the patient, once again, is not involved in progressive resistance training.

In a particular apparatus marketed under the tradename of "Strive" and referred to in their literature as the "Back/Ab Combo", active patient muscle activity is provided in the nature of progressive resistance training with a variety of resistance patterns. However, this device does not provide for decompression of the spine. Moreover, the resistance is applied through a gear mechanism that changes the motion of the resistance assembly with respect to the anatomical motion of the user. Further, although there is a mechanism provided for counterbalancing the patient's upper body weight, such counterbalancing is not closely matched to that upper body weight during the latter part of the motion. Additionally, this apparatus permits the patient to perform only two anatomical motions, torso extension and torso flexion.

A device generally referred to by the tradename of "NK Table" includes a table having a leg arm and a resistance arm. The leg arm is fixed to a rotating shaft mounted on the table. The resistance arm can be locked to different starting angular positions, while the leg arm is vertical. However, with the "NK Table", the anatomical starting position is fixed (i.e., at the vertical). In other words, with the "NK Table", the exercise motion must always begin with the lower leg in the vertical position.

Summing up, none of the "Medex", "Vivatek", "Vax-D", and "NK Table" apparatuses discussed above provide a means to efficiently develop new muscular recruitment pathways.

OBJECTIVES OF THE INVENTION

Accordingly, one objective of the present invention is the provision of a training apparatus for decompressing particular segments of the lower region of the spinal column, while simultaneously providing for active anatomical motion in a selected one of four directions around the pelvic girdle, namely torso flexion, torso extension, lateral extension left, and lateral extension right.

Another objective of the present invention is the provision of such a training apparatus that additionally does not lock the patient into a rigid position, thereby providing for synergistic activity of related soft tissue.

A still further objective of the present invention is the provision of a multitude of resistance patterns, with a variety of controlled resistance magnitudes.

Yet another object of the present invention is the provision of such a training apparatus, in which the torso extension motion, pivoting around the hip axis, (which would normally terminate with the user in a flat horizontal position) is extended by performing a pelvic lift across a lumbar pad. This extension of the torso extension motion generates spinal decompression in the user.

Yet another object of the invention is the provision of such a training apparatus in which a torso flexion motion begins at a somewhat extended position and goes beyond a normal flexion motion, so that a lumbar stretch is experienced as the user reaches for the floor.

The lateral extension motions, both left and right, provide a synergy of activity through the lower extremities to the soft tissue involved in the torso, as the user again reaches to touch the floor.

The apparatus provides a counterweight system to overcome the weight of the upper torso, so that each motion has an eccentric (muscle lengthening) as well as a concentric (muscle shortening) activity.

The type of activity that the user is involved in can be separated into three principal types. The first, which provides the greatest amount of decompression, is a rocking motion across the lumbar pad. The second, which provides for better transportation of toxins from the cells and transportation of nutrients to the cells, is a rocking motion in all of the various regions throughout the full range of motion. The third, which is integrated into this process, is the frequent movement through a full range of motion two or more times during the training process. Common to all of these three activities is that a selection of many different resistance magnitudes can be provided at any point in the range of motion. As a result of the different resistance magnitudes being provided at any point in the range of motion, many recruitment pathways are efficiently developed in the synergistically involved muscle segments. This results in the development of a high level of physical readiness, by which is meant muscular endurance, functional strength, range of motion, and work output.

Still further, rubber tension bands are integrated into the resistance source and apply greater resistance to the training arm in the latter part of the motion. Such rubber tension bands compensate for a decreased resistance provided by the counterweight(s) on the lower resistance lever as the motion proceeds from 90° to approximately 115°.

As used herein, the term "spinal decompression" refers to curvilinear spinal decompression, as opposed to linear spinal decompression, which is the type of spinal decompression effected by the Vax-D apparatus discussed herein. Additionally, the term "spinal decompression" as used herein refers to "active" spinal decompression as provided by progressive resistance training, as distinguished from passive spinal decompression, of which the Vivatek and Vax-D devices discussed herein are illustrative.

A still further objective of the invention is the provision of such a training apparatus that is extremely economic to manufacture and yet is at least as efficacious as other apparatuses in the field. For example, an apparatus according to the present invention may cost on the order of one tenth or less of other known devices. Such low cost of manufacture (and also simplicity of use) places the inventive training apparatus well within the home use category.

A yet further advantage and objective of the invention is the provision of a range of motion indicator for indicating the extent of the angular movement of each training repetition. This allows for the repetitions performed by any one particular patient to be quantified and therefore easily used in a progress report, evaluation, computer software program or the like.

In addition to the objectives and advantages listed above, various other objectives and advantages of the invention will become more readily apparent to persons skilled in the relevant art from a reading of the detailed description section of this document. The other objectives and advantages will become particularly apparent when the detailed description is considered along with the drawings and claims presented herein.

SUMMARY OF THE INVENTION

The foregoing objectives and advantages are attained by the various embodiments of the invention summarized below.

In one aspect, the invention generally features a training apparatus designed to improve the physical readiness level of the low back and pelvic girdle of an individual. The training apparatus includes a frame, a seat, a pivot mechanism mounted on the frame and providing a pivot point disposed adjacent the seat, an exercise arm extending outward from the pivot mechanism and rotatable about the pivot point, a resistance assembly extending outward from the pivot mechanism and rotatable about the pivot point. The exercise arm and the resistance assembly are linked to one another such that the exercise arm and the resistance assembly rotate as a single unit about the pivot point of the pivot mechanism. The resistance assembly includes a first resistance lever arm and a second resistance lever arm. The first resistance lever arm includes a counterweight. The second resistance lever arm has a weight attachment mechanism for attaching a stress weight thereto, and the second resistance lever arm is angularly offset from the first resistance lever arm by an angle about the pivot point of the pivot mechanism.

In another aspect, the invention generally features a training apparatus designed to improve the physical readiness level of the low back and pelvic girdle of an individual. The training apparatus includes a frame, a seat, a pivot mechanism mounted on the frame and providing a pivot point disposed adjacent the seat, an exercise arm extending outward from the pivot mechanism and rotatable about the pivot point, and a resistance assembly extending outward from the pivot mechanism and rotatable about the pivot point. The exercise arm and the resistance assembly are linked to one another such that the exercise arm and the resistance assembly rotate as a single unit about the pivot point of the pivot mechanism. The resistance assembly includes at least a first resistance lever arm having a counterweight. The counterweight has a weight substantially sufficient to counterbalance an upper torso weight of an individual exerted on the exercise arm when such individual is seated in the seat and exerting such upper torso weight against the exercise arm.

In yet another aspect, the invention generally features a seating and positioning apparatus for a training apparatus in which an individual performs bending movements about the hip axis. The seating and positioning apparatus includes a frame, a seat having an upper surface, and a thigh engagement device for contacting and restraining an upper surface of a thigh of an individual utilizing such training apparatus and seated on the seat such that a buttocks portion of such individual is in contact with the upper surface of the seat.

DETAILED DESCRIPTION OF THE PREFERRED EMBODIMENT OF THE INVENTION

Initially, the terms "individual", "patient", "user", and the like are used interchangeably herein to denote a person using the inventive training apparatus described herein for the purpose of improving the physical readiness level of that person's low back and pelvic girdle physiology. This may be for purposes of rehabilitation or just for general improvement such physiology (e.g., to improve the strength and flexibility of such region).

Figure 1:
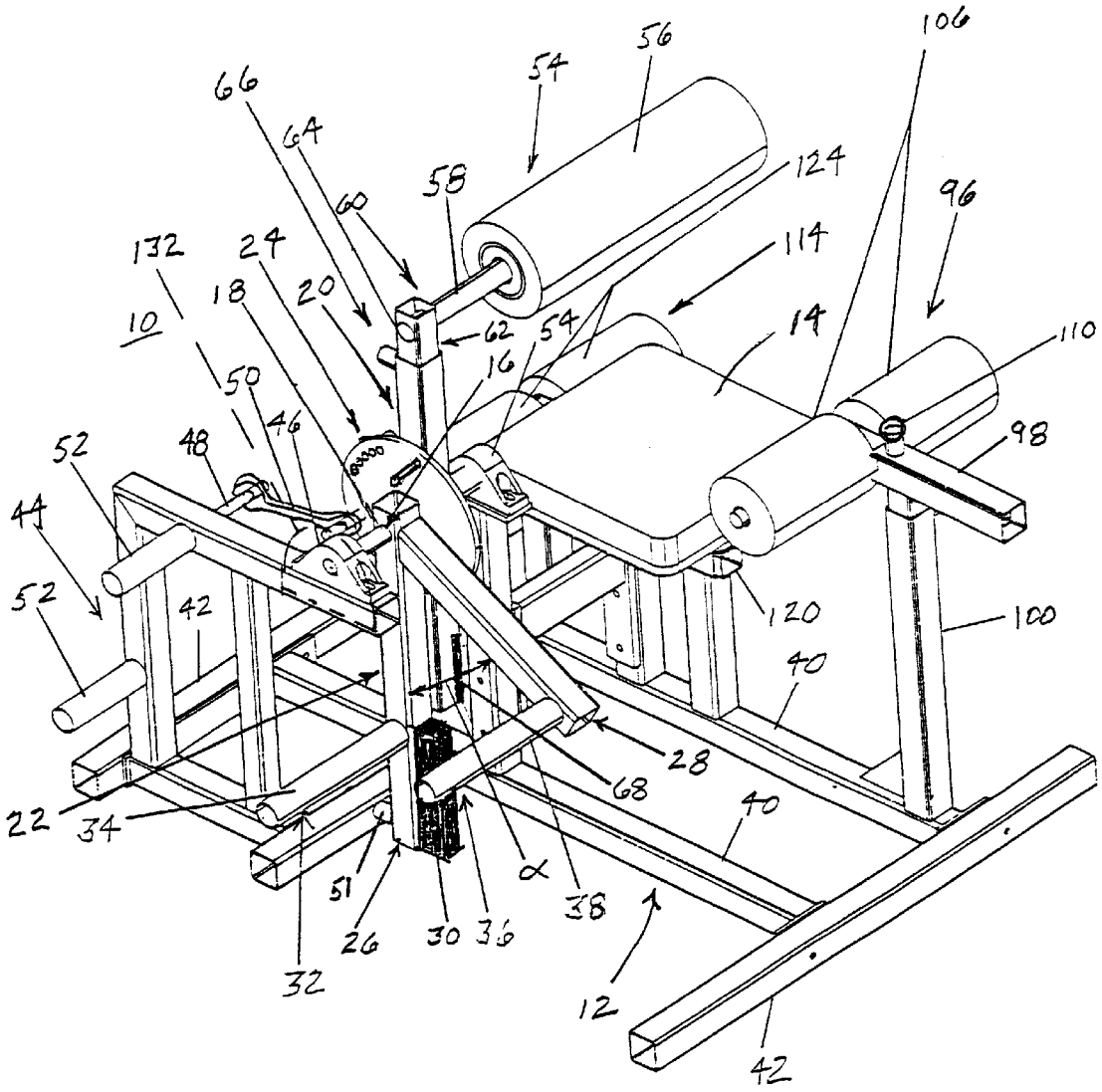
FIG. 1 is a perspective view of a pelvic rocker training apparatus constructed according to the present invention.

Referring most particularly to FIG. 1, a training apparatus constructed according to the present invention is generally indicated by reference numeral 10. The training apparatus 10 includes a frame 12, which rests on the ground or floor and which supports a seat 14 in an elevated position with respect to the floor or ground. A pivot mechanism 16 is mounted on the frame 12 and disposed with respect thereto so as to be substantially adjacent to the seat 14. The pivot mechanism 16 provides a pivot point 18 about which various working components of the training apparatus rotate. More particularly, the training apparatus additionally includes an exercise arm 20 and a resistance assembly 22. Both of the exercise arm 20 and the resistance assembly 22 are pivotally mounted to the frame 12 by the pivot mechanism 16 and are therefore rotatable about the pivot point 18 with respect to the frame 12. It should be noted that the exercise arm 20 and the resistance assembly 22 are independently rotatable with respect to the frame 12 about the pivot point 18. This permits the exercise arm 20 to be rotated, independently of the resistance assembly 22, to a selected anatomical starting position for training. However, the exercise arm 20 and the resistance assembly 22 are linked to one another through an interlocking mechanism 24 such that, during use by an individual or patient (i.e., during a training motion), the exercise arm 20 and the resistance assembly 22 rotate as a single unit about the pivot point 18 provided by the pivot mechanism 16. The particulars of the interlocking mechanism 24 are discussed and described more fully below.

The resistance assembly 22, which extends generally downward (due to its weight) from the pivot point 18 includes a first resistance lever arm 26 and a second resistance lever arm 28, each of which extends radially outward from the pivot point 18. The first and second resistance levers 26 arms and 28, respectively, are preferably rigidly connected to one another such that they rotate about the pivot point 18 as a single component. A counterweight 30 is secured (preferably, relatively permanently) to the radially outward (or distal) end of the first resistance lever arm 26. The second resistance lever arm 28 is angularly displaced (or offset) with respect to the first resistance lever arm 26 by a specified angle $\alpha$. In the presently preferred embodiment, the angle $\alpha$ is substantially equal to about 80°. However, it should be noted that the choice of $\alpha$ as being substantially equal to about 80° is not absolutely critical. Other offset angles could be employed to achieve desirable results as that obtained in the presently preferred embodiment, without departing from either the spirit or scope of the invention.

The primary function of the counterweight 30 is to provide a counterbalance to the weight of the upper torso of a patient or individual using the training apparatus 10. The average head of an individual weighs on the order of about 13 pounds. When any of a torso flexion motion, a torso extension motion, a lateral left bending motion, or a lateral right bending motion about the hip axis is performed by a seated individual, considerable torque is involved due to the weight of the upper torso (including the head) acting at its respective distance from the hip axis. The further that the upper torso is inclined from the vertical, the more severe the torque exerted by upper torso. This torque must be supported/resisted by the pelvic girdle (lumbar) physiology. For individuals with lower back pain, any bending motion about the hip axis can be quite painful. However, it is these motions that must be performed to achieve improvement. The counterweight 30 attached to the distal end of the first resistance lever arm 26 functions to substantially effectively cancel out at least all of the torque exerted by the upper torso as it is rotated from the vertical. In other words, whether performing any of the four training motions identified above, the exercise arm 20, which is in contact with the upper torso of the individual, exerts a counter torque that acts against the torque produced by the upper torso weight of the individual. The result is a relative sensation of weightlessness as any of the four training motions are performed. This allows the individual to perform training motions which would be too painful without the counterbalancing effect, and the mere performing of such repetitive training motions causes curvilinear (non-linear) spinal decompression with active muscular participation on the part of the individual, which, as pointed out above, has clear therapeutic advantages. The individual or patient may be encouraged to "rock" back and forth as far as can be tolerated without excess pain, each motion resulting in active muscular participation and curvilinear spinal decompression.

Once a reasonable pain free range of motion is achieved, progressive resistance training can be implemented by adding stress weights to either of the first resistance lever arm 26 and/or the second resistance lever arm 28 in a manner selected to be appropriate.

The radially outward (or distal) end of the first resistance lever arm 26 is provided with a first weight attachment device 32 for attaching an additional counterweight (or counterweights) thereto. Preferably, the first weight attachment device 32 is provided in the form of a rod 34, which extends horizontally outward (i.e., parallel to the axis of the pivot point 18) from the distal end of the first resistance lever arm 26. The radially outward (or distal) end of the second resistance lever arm 28 is similarly preferably provided with a second weight attachment device 36 for facilitating the attachment of "stress weight" thereto. Similarly, the second weight attachment device 36 is preferably provided in the form of an additional rod 38 extending horizontally from the distal end of the second resistance lever arm 28.

As the term is used herein, "counterweight" refers to a weight used to provide a counterbalancing effect to the upper torso weight of an individual. Such counterweight is added only to the first resistance lever arm 26. In contrast, "stress weight" refers to a resistance weight that is employed to produce an additional resistive force during a portion of the training motion, as, for example, in progressive weight (or resistance) training. Such stress weight can be added to either of first resistance lever arm 26 or the second resistance lever arm 28.

The "stress weights" and any additional counterweight(s) that can be optionally attached to the first weight attachment device 32 and the second weight attachment device 36 are preferably of the conventional "barbell" type weights, which are widely available and well known. Such "barbell" type weights are disc-shaped and provided with a central hole of a standardized diameter. They slide onto the ends of a barbell and are commonly clamped axially by a sliding clamp. The rod 34 and the additional rod 38 are sized to accept such "barbell" type weights. In practice, it has not been found necessary to employ the typical clamping mechanisms as are used on conventional barbells, since the rod 34 and the additional rod 38 are maintained in a horizontal disposition throughout the training movements, due to the rigidity and relative immobility of the frame 12.

The frame 12 is, in overall general construction, preferably fabricated from tubular steel of generally square cross section and includes a pair of longitudinal base members 40, which extend parallel to one another in a fore/aft configuration and are disposed beneath and on generally opposite sides of the seat 14. Two transverse base members 42 connect between and extend beyond the ends of the two longitudinal base members 40. The frame 12 is thereby provided with substantial stability and resistance to any tipping motion. The two transverse base members 42 serve an additional function by providing anchors for placement of the user's feet.

An outrigger frame portion 44 is constructed to one side of one of the longitudinal base members 40. The outrigger frame portion 44 serves a number of functions: it furnishes a rigid mounting position for an outboard rotational bearing 46 (discussed more fully below); it provides a rigid mounting position for a first connection member 48, to which at least one elastic resistance element 50 may be attached (also discussed more fully below); it provides a mounting position for a bumper member 51 (preferably elastomeric) which contacts the first resistance lever arm 26 in a substantially vertical position and prevents it from counter rotation past the vertical; and it provides a structure upon which additional weights can be stored. As to the last function, preferably two further rods 52 project outward and horizontally from the outrigger frame portion 44. Additional "barbell" type weights, for use on the rod 34 and the additional rod 38, may be integrally stored with the training apparatus 10 by sliding them onto the further rods 52 provided on the outrigger frame portion 44.

The exercise arm 20 includes a torso-contacting portion 54, which extends substantially parallel to the axis of rotation of the pivot mechanism 16 and substantially over the seat 14. The torso-contacting portion 54 includes a cylindrical bolster 56, which is mounted on one arm 58 of an L-shaped armature 60. The exercise arm 20 also includes a torso-contacting adjustment mechanism 62, wherein another arm 64 of the L-shaped armature 60 is preferably formed of square cross-section tubular steel and telescopes into a similarly configured, but of slightly larger cross section, portion of the exercise arm 20. A holding device 66 secures the telescoping arm 64 and exercise arm 20 to the selected degree of extension. The holding device 66 is preferably a "pop pin" mechanism or a "tension knob" mechanism, as described more fully below. Additionally, both a "pop pin" mechanism and a "tension knob" may be used together in combination, so as to allow both quick adjustment and in order to remove any slack motion from the connection.

As can be seen from FIG. 1, the exercise arm 20 extends across the pivot point 18. The portion of the exercise arm 20 disposed on the opposite side of the pivot point 18 from the torso-contacting portion 54 serves, at least to some degree, to counterbalance the weight of the exercise arm 20 and torso-contacting portion 54 located on one side of the pivot point 18. Still, however, when the exercise arm 20 is uncoupled from the resistance assembly 22, the exercise arm, by itself, becomes unbalanced. To counteract this, a further counterweight 68 is attached to the end of the exercise arm 20 disposed across the pivot point 18 from the torso-contacting portion 54. This further counterweight 68 may be in the form of a permanently attached counterweight or a "barbell" type weight.

Figure 2:
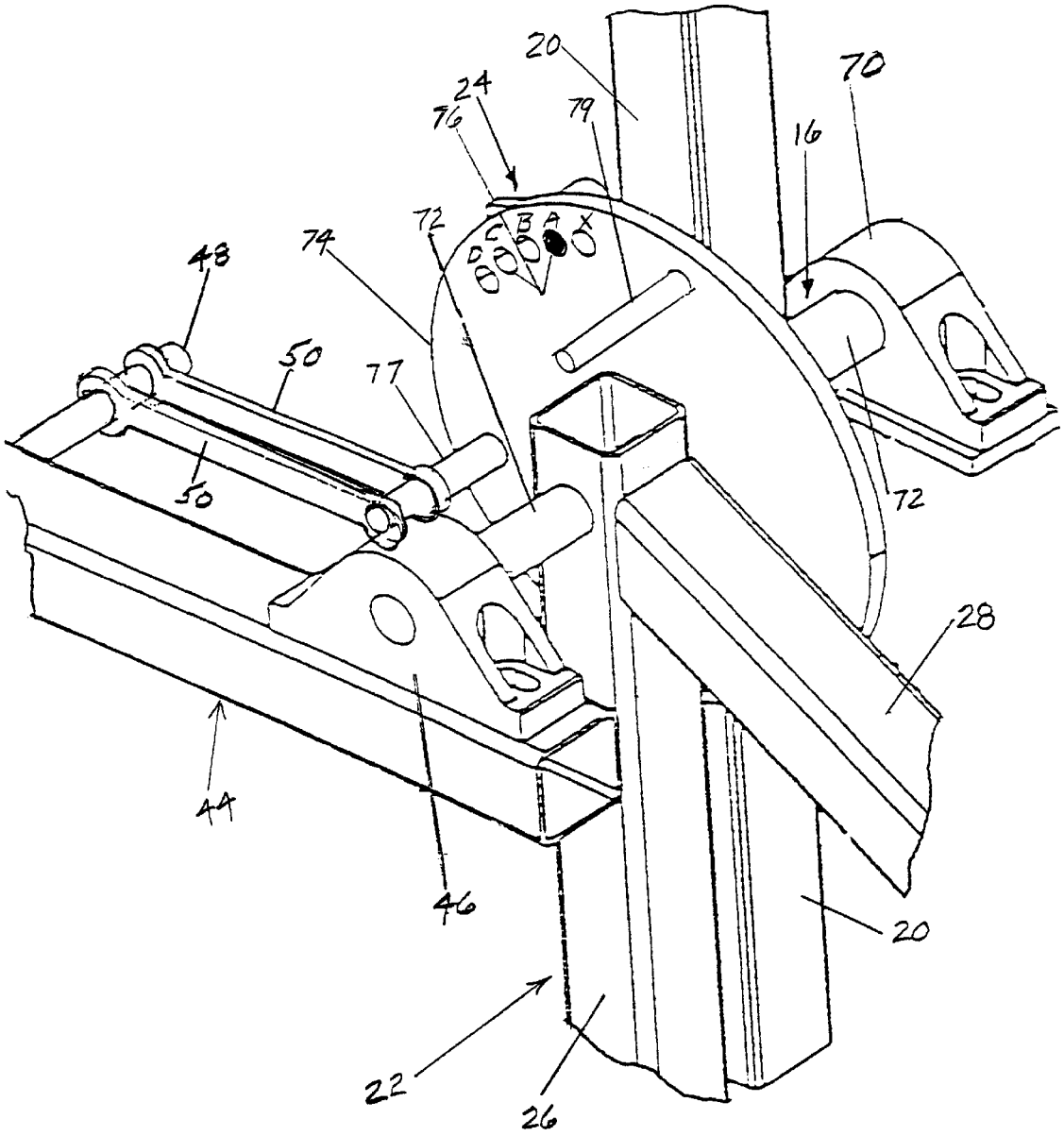
FIG. 2 is an enlarged portion of the perspective view of FIG. 1, showing more particularly a pivot mechanism, an angular adjustment mechanism, and the connection of at least one elastic resistance element to the pelvic rocker training apparatus of the present invention.

Referring most particularly now to FIG. 2, which is an enlarged perspective view of the pivot mechanism 16, the interlocking mechanism 24, and structure adjacent thereto, the pivot mechanism 16 includes and is located between the outboard rotational bearing 46 (mounted on the outrigger 44) and an inboard rotational bearing 70, which is mounted on the frame 12 substantially adjacent the seat 14. An axle 72 is rotationally mounted in each of the outboard and inboard rotational bearings 46 and 70, respectively, by which means the axle 72 is thereby rotationally mounted to the frame 12. The resistance assembly 22, which includes the first and second resistance lever arms 26 and 28, respectively, is preferably permanently connected to the axle 72 (e.g., as by welding) so as to rotate integrally therewith. A radial flange 74 is preferably permanently connected (e.g., by welding) to the resistance assembly 22, and surrounds and extends radially outward from the axle 72. Thus, the axle 72, the resistance assembly 22, and the radial flange 74 all pivot as a singular unit within journals provided by the outboard and inboard rotational bearings 46 and 70, respectively. The radial flange 74 is provided with a sequential series of preferably evenly spaced holes 76 which are spaced radially outward from the axle 72. As described below, a plunger mechanism (e.g., a "pop pin" mechanism) connected to the exercise arm 20 engages a selective one of the holes 76 to provide the interlocking mechanism 24 that interlocks the exercise arm 20 and the resistance assembly 22 together at one of a selected plurality of angular dispositions.

A second connection member 77 (i.e., a pin) projects outwardly from the radial flange 74. The other end of the elastic resistance element 50 attaches to the second connection member 77. During a training motion in which the resistance lever arm 26 is moved toward the extreme limit of its range of motion (i.e., when the resistance lever arm 26 passes 90° from its original or rest position), the counter torque that it exerts begins to diminish. At such time, the elastic resistance element 50 is approaching its maximum degree of elongation. Thus, at this point, the elastic resistance element 50 furnishes additional counter torque to compensate for the decreased counter torque provided by the weighted resistance lever arm 26.

Also shown in FIG. 2, is a pin 79 extending outwardly from the radial flange 74, which will encounter outrigger frame portion 44, when the resistance assembly 22 has rotated approximately 115°. This provides a safety stop that prevents over-rotation of the resistance assembly 22.

Figure 3:
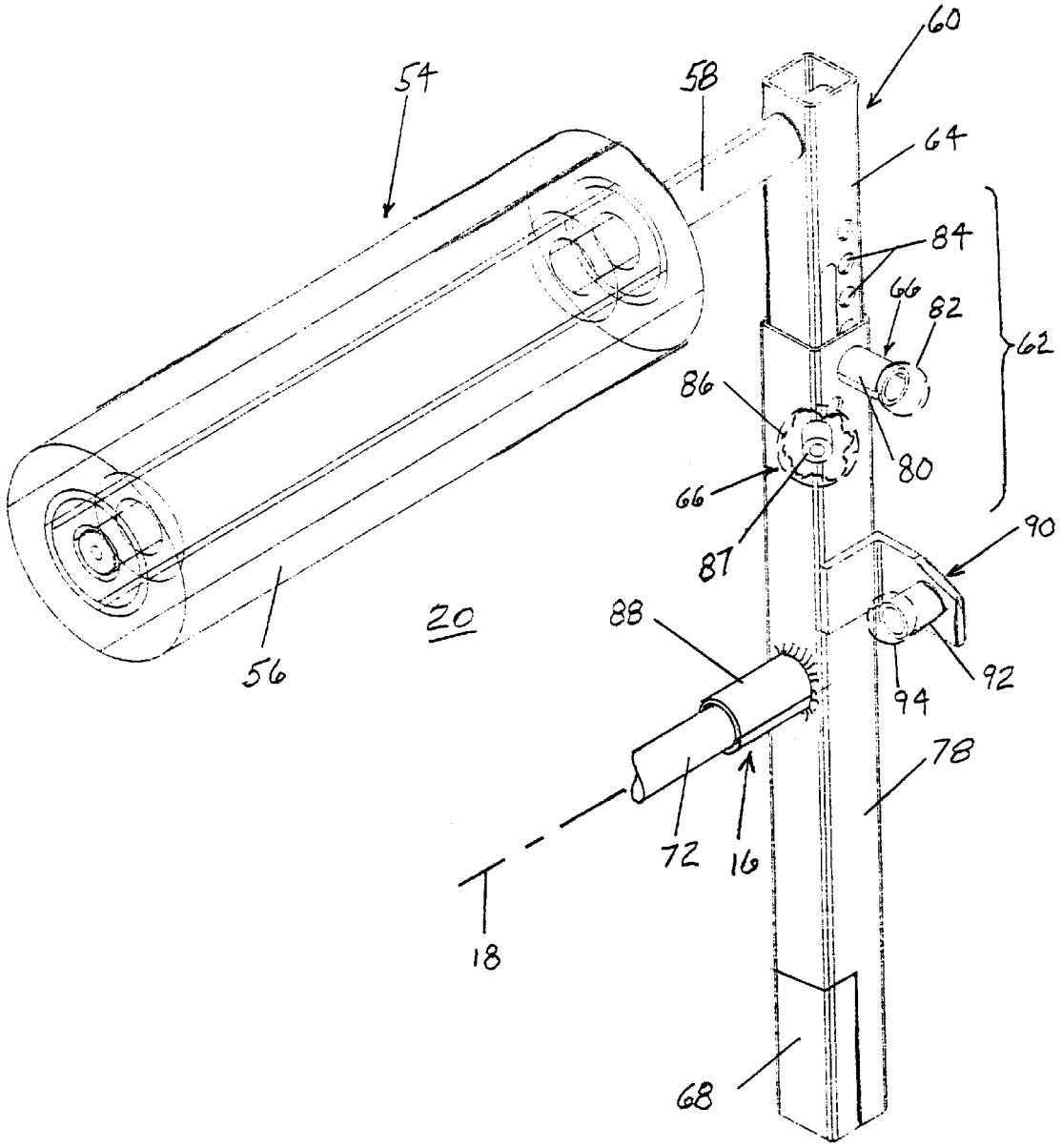
FIG. 3 is a more detailed perspective view of an exercise arm component of the inventive pelvic rocker training apparatus.

We turn now principally to FIG. 3, which is a more detailed perspective view of the exercise arm 20. The exercise arm 20, in addition to the components described previously, includes a lower chamber portion 78, into which the other arm 64 of the L-shaped armature 60 telescopes. The lower chamber portion 74 is preferably provided with two separate holding mechanisms 66 to fix the extendable L-shaped armature 60 at a selected configuration. A first of the holding mechanisms 66 includes a first hollow cylindrical stub 80 outstanding from a planar face of the lower chamber portion 78. Preferably, what is herein referred to as a "pop pin" mechanism 82 is secured to the first cylindrical stub 80. Such a "pop pin" mechanism 82 is well known in the mechanical arts and includes a spring-loaded plunger that is biased toward an inward direction. The plunger typically engages a hole, depression, or the like to lock two sliding members in one of a plurality of selected relative positions. The connection can be released by retracting the "pop pin" (or plunger) mechanism against the spring bias. The members may then be slid to another relative positioning and the pop pin released so as to again engage the locking action.

A number of such pop pins are employed in the present invention for adjusting to the anatomy of various individuals.

The pop pin mechanism 82 engages a selected one of a plurality of holes 84 provided on the arm 64 of the L-shaped armature 60, thereby allowing adjustment of the height of the torso-contacting portion 54 above the seat 14.

The second of the holding mechanisms 66 includes a second hollow cylindrical stub 87 that protrudes outward from a corner edge of the lower chamber portion 78. A "tension screw" holding mechanism 86 is mounted in this second cylindrical stub 87 and serves to securely fix and remove any slack from the telescoping connection between the arm 64 and the lower chamber portion 78. As used herein, the term "tension screw" mechanism or the like refers to the well known mechanical connection device wherein a threaded screw member may be rotated (as with a hand knob) so as to "bite" into an adjacent member and fix an otherwise sliding or telescoping connection between the members.

A number of such tension screws are employed in the present invention for adjusting to the anatomy of various individuals.

With the holding mechanisms 66 so described, the height of the torso-contacting portion 54 above the seat may be quickly selected using the pop pin mechanism 82. Any slack between the two telescoping members may then be removed by rotating the tension screw mechanism 86 inward.

The lower chamber portion 74 includes a hollow cylindrical sleeve 88 that projects therefrom parallel to the torso-contacting portion 54. The sleeve 88 surrounds the axle 72 and is rotatable thereabout, thus allowing the exercise arm 20 to pivot about the pivot mechanism 16.

An L-shaped flange member 90 is connected to the lower chamber portion 74 (e.g., by welding). A hollow cylindrical stub 92 projects from one arm of the L-shaped flange member 90. A pop pin mechanism 94 (i.e., a plunger mechanism) is attached to the cylindrical stub 92. The plunger portion of the pop pin mechanism 94 engages a selected one of the sequential holes 76 provided in the radial flange 74 and seen most clearly in FIG. 3. The pop pin mechanism 94 can be selectively engaged with any one of the holes 76, whereby the angular relation between the exercise arm 20 and the resistance assembly 22 can be adjusted. This allows the initial position of the exercise arm 20 to be set to vertical or to different off-vertical inclinations to accommodate the abilities of various patients or individuals.

Figure 4:
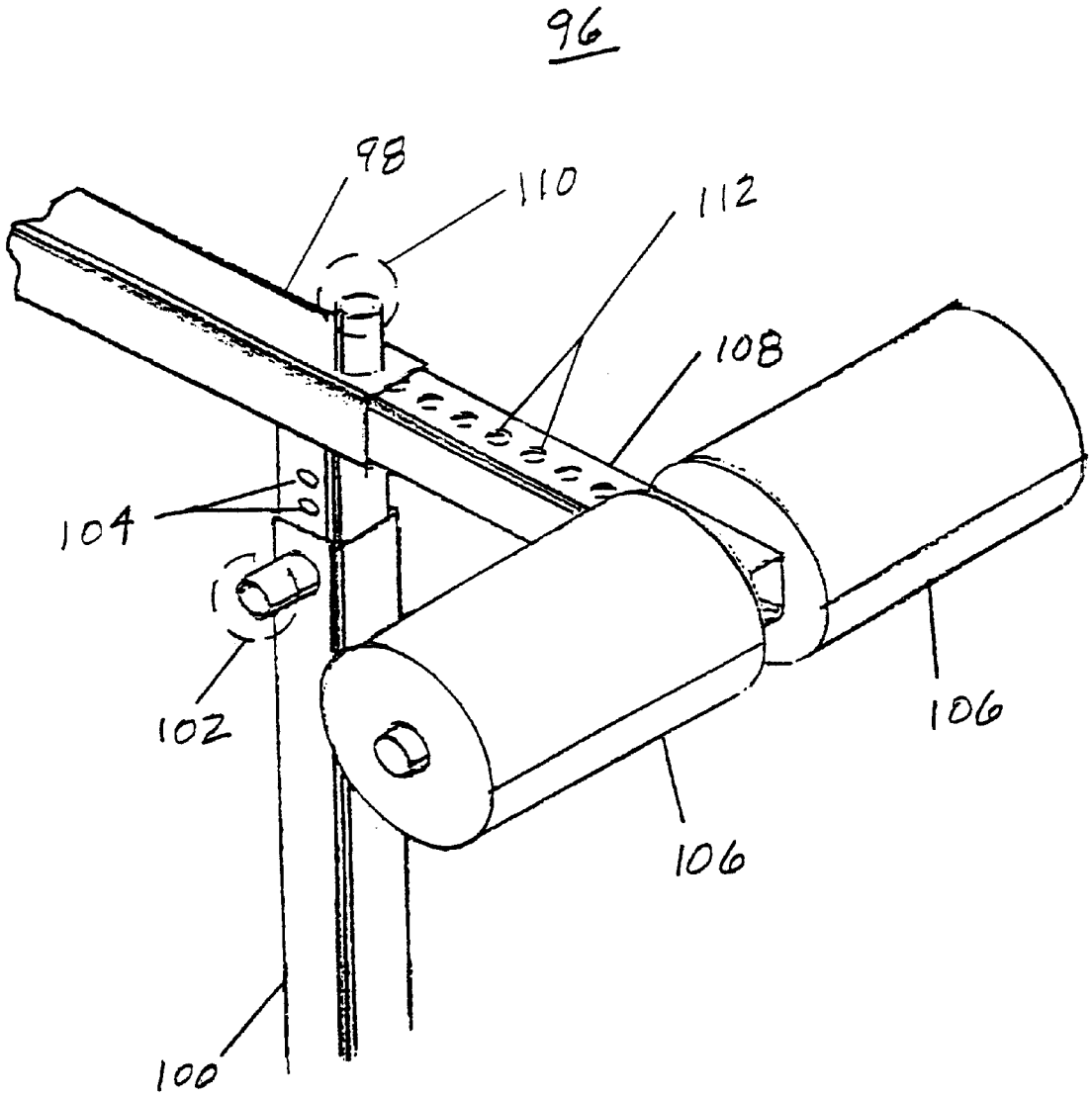
FIG. 4 is a more detailed perspective view of a thigh engagement device component of the inventive pelvic rocker training apparatus.

Referring now primarily to FIGS. 1 and 4, the training apparatus 10 preferably also includes a thigh engagement device 96. This thigh engagement device 96 is utilized when the patient is performing an extension motion about the hip axis. In such a situation, the thigh engagement device 96 is positioned such that it contacts and prevents any significant upward motion of the upper surface of the thighs of the patient. Preferably, the thigh engagement device 96 is positionable as to both its height and lateral positioning and, to this end, includes a T-shaped armature 98 which slidingly telescopes into an upright stanchion 100 provided on the frame 12. The height of the T-shaped armature 98 relative to the stanchion 100 is adjustable via a pop pin mechanism 102, which selectively engages one of a series of holes 104 provided on the T-shaped armature 98. A pair of horizontally positioned thigh bolsters 106 are mounted on opposite sides of an adjustable armature 108, which slidingly telescopes into a top arm of the T-shaped armature 98. The lateral positioning of the bolsters 106 relative to the seat 14 is adjustable via another pop pin mechanism 110, which selectively engages with a selected one of a series of holes 112 provided in the upper surface of the adjustable armature 108.

Figure 5:
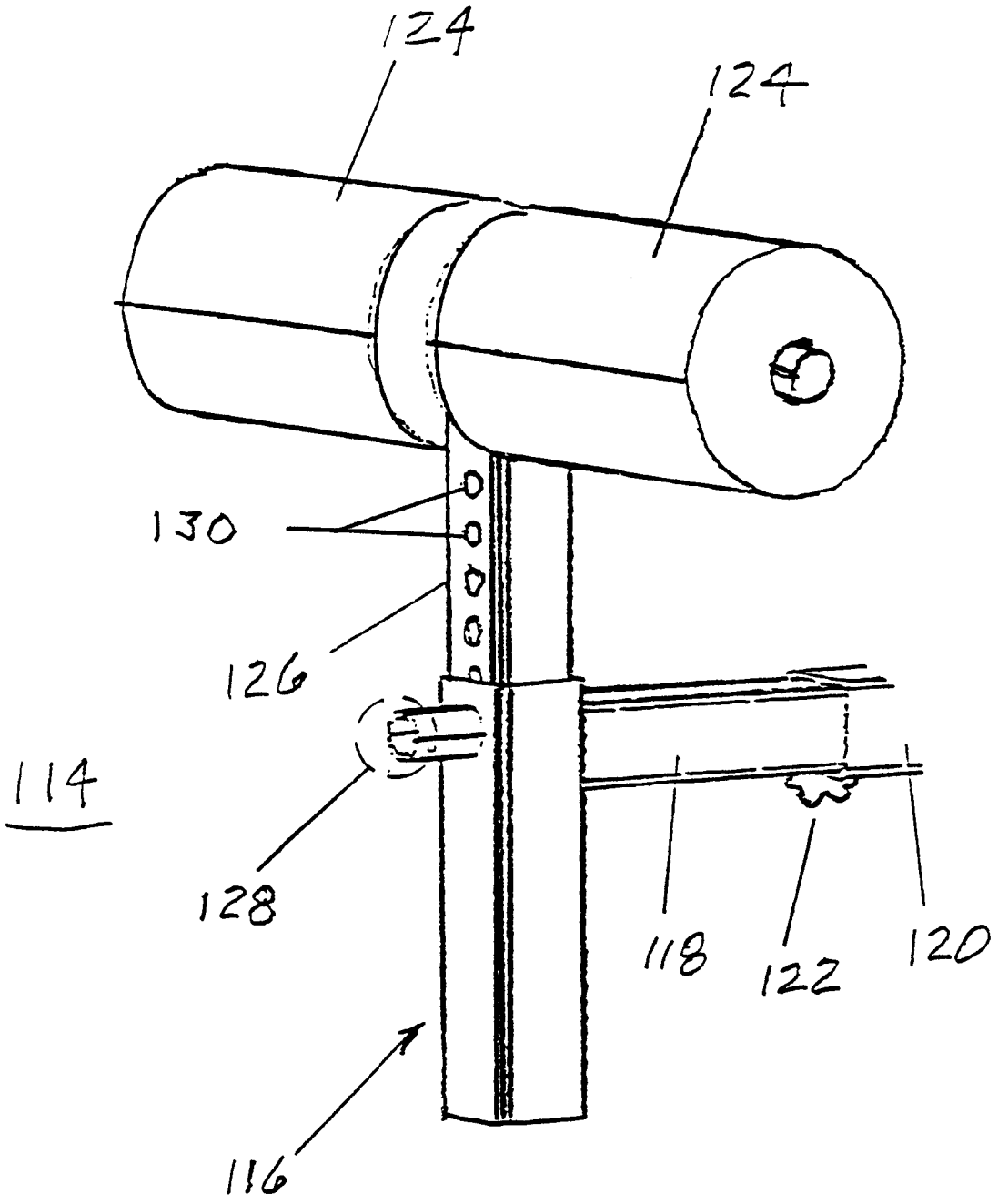
FIG. 5 is a more detailed perspective view of a lumbar positioning device component of the inventive pelvic rocker training apparatus.

Referring now primarily to FIGS. 1 and 5 the training apparatus 10 preferably also includes a lumbar positioning device 114 for contacting and positioning the lumbar region of a user performing a torso extension movement. The lumbar positioning device 114 includes another T-shaped armature 116 having an arm 118 that slidingly telescopes into a beam portion 120 of the frame 12. The beam portion 120 of the frame 12 is positioned immediately beneath the seat 14 and aligned in parallel with the two longitudinal base members 40. [A portion of the beam portion 120 is visible in FIG. 1.] A tension screw device 122, which is preferably located on a corner edge of the beam portion 120 and projects therethrough, serves to clamp the arm 118 of the T-shaped armature 116 into a selected degree of telescopic extension with respect to the beam portion 120, which thereby selects the horizontal positioning of the lumbar bolsters 124 with respect to the seat 14. A pair of horizontally positioned lumbar bolsters 124 are mounted on opposite sides of another adjustable armature 126, which slidingly telescopes into one arm of the T-shaped armature 116. A further pop pin mechanism 128 coacts with a series of holes 130 provided on the armature 126 to select and maintain the vertical height of the lumbar bolsters 124 relative to the seat 14.

Figure 6:
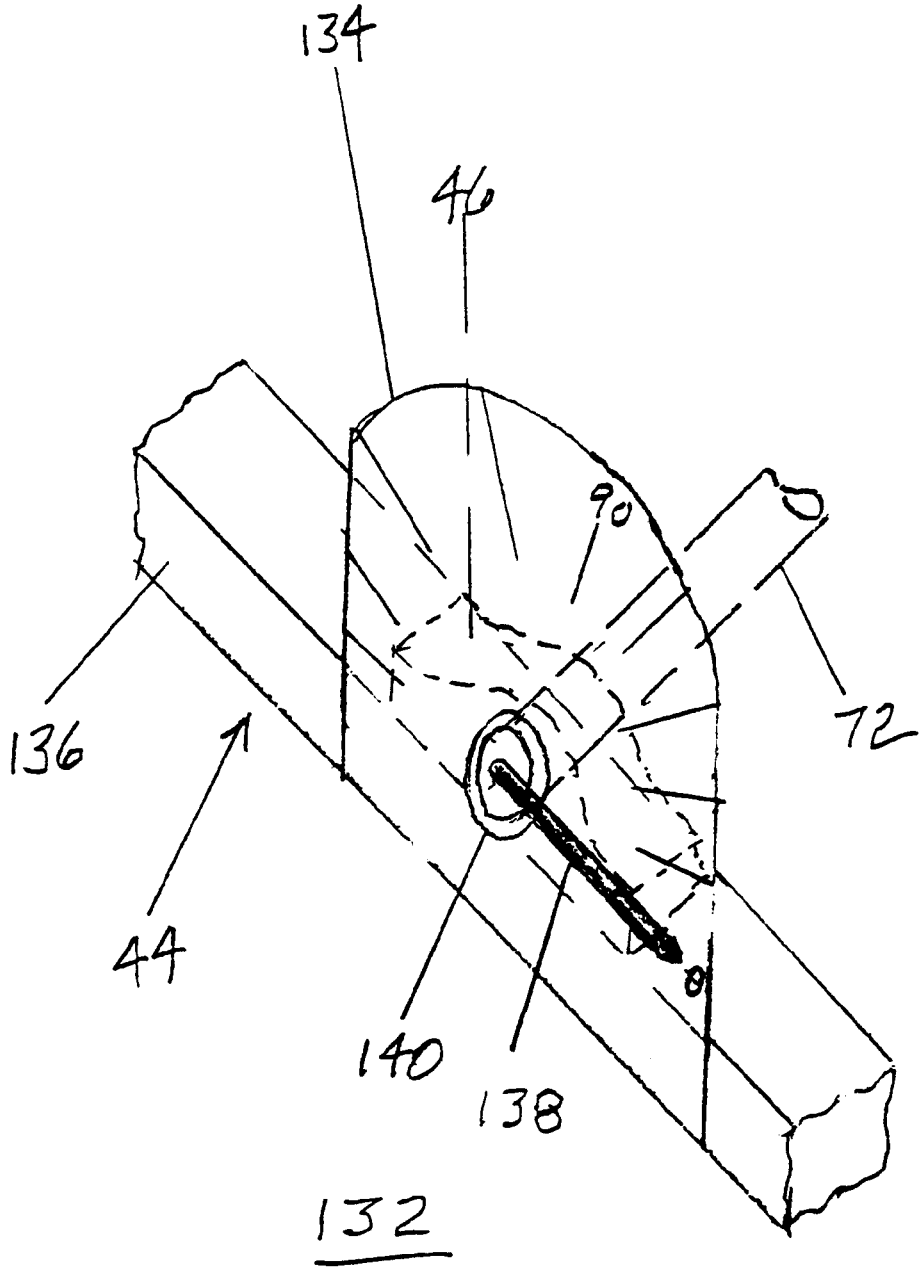
FIG. 6 is a perspective view of a goneometer (i.e., angular measurement) device of the inventive pelvic rocker training apparatus.

Referring now in particular to FIG. 6, the training apparatus 10 is preferably provided with a "goneometer" device 132 for displaying (e.g., to an attending physical therapist) the degree of rotation of the resistance assembly 22 relative to the frame 12. The term "goneometer" is used herein to describe a device for visually displaying the rotation of the resistance assembly 22 relative to the frame 12. In the presently preferred embodiment, a simple mechanical "protractor" type device is employed. Clearly, however, more esoteric devices (e.g., electronic rotation indicators, etc.) could be substituted. The goneometer device 132 includes a striated gauge plate 134 that is rigidly connected to a rail member 136 of the outrigger frame portion 44 of the frame 12. An indicator member 138 is rigidly connected to the axle 72, which projects slightly through an aperture 140 provided in the striated gauge plate 134. Preferably, the striated gauge plate 134 is marked with radii every 15°, with 5° subdivisions thereof being shown. The position of the resistance assembly 22 in its rest position is indicated at 0°. Provision of the goneometer device 132 allows the performance/progress of an individual to be quantified, which has substantial value in recording performance, either tabularly or by way of computer software, for example. Thus, improvement in range of motion can be documented, both for medical review and for purposes of billing (e.g., Medicare, etc.).

Operation

The inventive training apparatus 10 has four primary modes of operation: torso extension; torso flexion; torso lateral bending left; and torso lateral bending right (which are discussed immediately below). In each of these modes of operation, spinal decompression is effected, at different angles and to varying degrees.

Torso Extension:

In performing a torso extension movement, the individual is seated on the seat 14, facing forward (i.e., with the bolster 56 on the exercise arm 20 adjusted against the individual's back, high on the scapular area). The thigh adjustment device 96 is adjusted such that the thigh bolsters 106 firmly restrain the individual's thighs against upward motion. The individual places his/her feet on the front transverse base member 42. The individual then rocks back against the counter torque exerted by the resistance assembly 20 and transmitted through the exercise arm 20.

The starting position of the exercise arm 20 is adjusted by way of the interlocking mechanism 24 so that the individual will be relatively pain free in a seated position, before beginning the torso extension movement. The preferred starting position is with the exercise arm 20 substantially vertical, which is achieved using the hole 76 indicated by the legend "A", as seen in FIG. 2. However, some individuals may experience pain in this initial starting position. If so, the starting position of the exercise arm 20 may be inclined further back via the interlocking mechanism 24, e.g., by using the holes 76 labeled "B", "C", or "D". The hole 76 labeled "X" is for individuals needing a greater degree of flexion in the starting position. However, this is not the usual recommended starting position.

With a starting position selected, the individual is encouraged to rock back in a torso extension motion. The motions may be best viewed as divided into 30° segments. The individual will hopefully be able to extend by at least 30° from the initial starting position. If not, then the furthest extension from the starting position achievable by the individual without undue pain should be noted, and the individual encouraged to rock back to this limit and to attempt extending the relatively pain free limit of extension. If an initial 30° extension is achieved, then further extension may be attempted in 30° increments. The individual is encouraged to rock back to the relatively pain free limit, and to return only partially to the starting position, before again extending, i.e., rocking back again. Periodically during such a rocking motion, the individual is directed to perform a full motion at least two consecutive times (i.e., a motion beginning at the starting position and proceeding to the relatively pain free limit).

If and/or when the individual is able to reach the extreme range of travel of the resistance assembly 22, the most significant degree of spinal decompression is believed to occur. The inventive training apparatus 10 is unique in allowing both the gluteus maximus muscles and the hamstring muscles of the individual to become synergistically involved in the training, through the performance of a motion referred to herein as a "pelvic lift". In such a pelvic lift, when the individual reaches the maximum extension obtainable using primarily the extensor muscles of the back (i.e., at about 90° movement of the resistance assembly 22), further movement of the resistance assembly 22 can be effected by synergistically involving (i.e., energizing) the gluteus maximus muscles. This is accomplished by having the individual lift his/her pelvic region against the restraint provided by the thigh bolsters 106. Use of the gluteus maximus muscle group in performing the pelvic lift can further the movement of the resistance assembly 22 back to approximately 108°. Even further movement of the resistance assembly 22 can be obtained by now extending the pelvic lift movement through the activation of the hamstring muscle groups (primarily the "high" hamstrings, that is, the proximal attachment thereof). This extending of the pelvic lift through involvement of the hamstring muscle group can cause rotation of the resistance assembly 22 to the full extent permitted, i.e., 115°.

Figure 7:
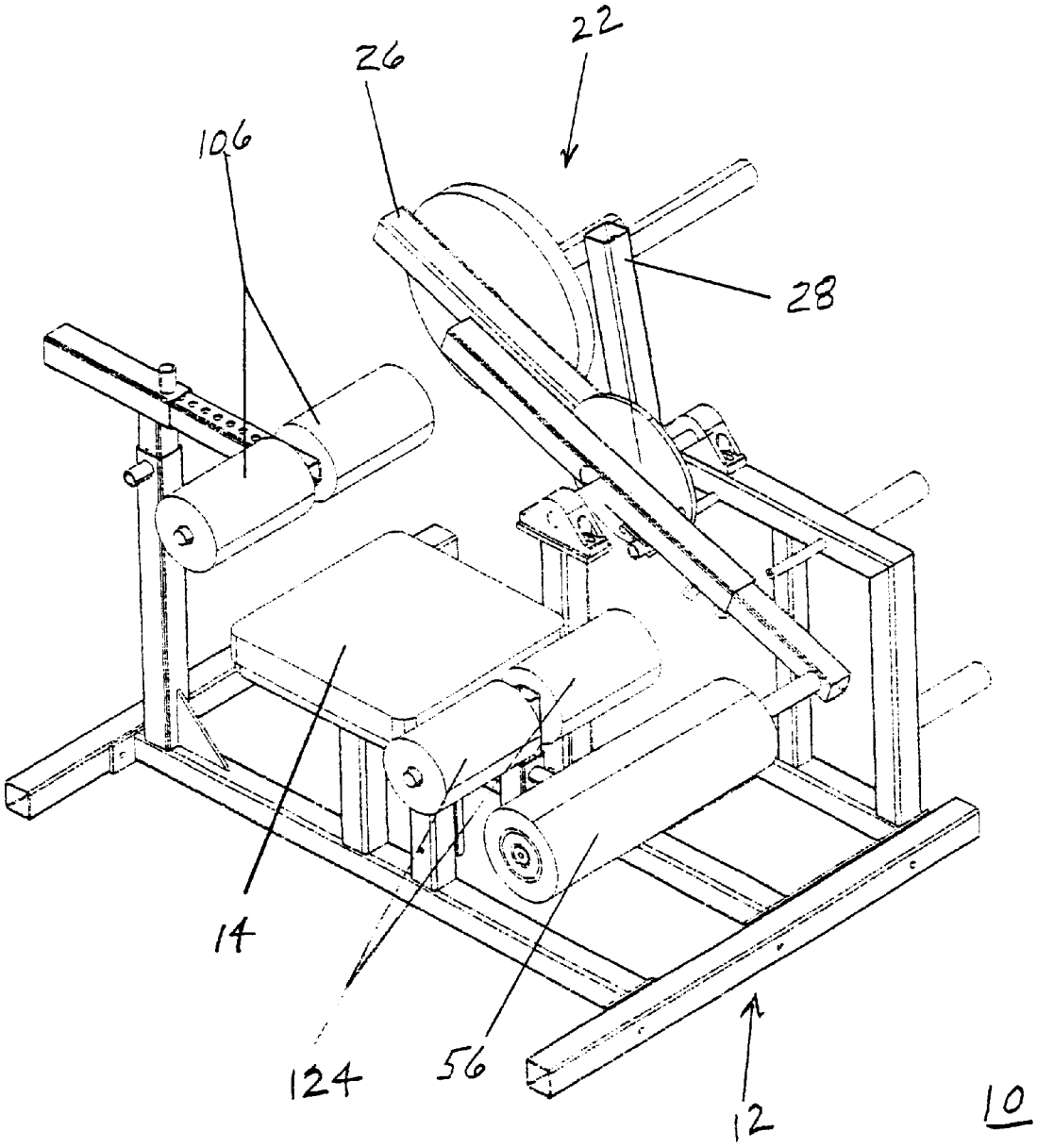
FIG. 7 is a perspective view illustrating the inventive pelvic rocker training apparatus in a configuration wherein a resistance assembly thereof is rotated to its most extreme degree of rotation.

FIG. 7 shows the training device 10 at its most extreme range of travel, i.e., with the resistance assembly 22 displaced 115° from its initial resting position. It will be seen from FIG. 7, that "hyperextension" occurs at the most extreme range of travel, with the individual extending beyond the normally flat, prone position. During such a hyperextension, the lumbar bolsters 124 come into significant contact with the lumbar region of the individual and accentuate the spinal decompression effect.

Torso Flexion:

The individual is seated, and the height of the bolster 56 of the exercise arm 20 adjusted so as to contact his/her chest region. The individual's arms are draped over the bolster 56. The feet of the individual are placed on the rear transverse base member 42. Once again the individual is encouraged to perform a rocking motion, in a forward bending movement with the upper body inclining toward the floor. The same general guidelines set forth above are observed as regards 30° ranges of movement; motions that attempt to extend the relatively pain free zone, and performing at least two consecutive relatively pain free full range motions periodically during the general rocking motion. To even further activate soft tissue involvement (e.g., in the sacrum area), the individual can perform a "pelvic roll", wherein the individual attempts to touch the floor, to place the palms on the floor, etc. The hamstring area can be even further synergistically involved if the feet of the individual are placed far forward on the floor (i.e., in front of the transverse base member 42) while performing such a "pelvic roll".

During a "pelvic roll" movement, since the individual stretches so far forward and down, the buttocks actually roll forward and out of the seat 14, to such an extent that the distal (insertion) portion of the hamstrings becomes the primary point of contact between the individual and the seat 14.

Lateral Bending (Left and Right):

For lateral bending left, the individual is seated sideways, facing away from the resistance assembly 22, while, for lateral bending right, the individual is seated sideways facing the resistance assembly 22. The arm to which side the lateral bend is to be performed is draped over the bolster 56. The opposite foot of the individual is positioned against the transverse base member 42 closest to that foot. The individual then bends laterally parallel to the hip axis, following the general guidelines set forth above as regards 30° ranges of movement, motions that attempt to extend the relatively pain free zone, and performing at least two consecutive full range relatively pain free motions periodically during the general rocking motion.

The lateral bending movements (left and right) can be accentuated by having the individual attempt to touch the floor with the arm that extends over the bolster 56, while the opposite foot remains in contact with the transverse base member 42. This causes a controlled therapeutic stress to be placed on the hip joint, i.e., soft tissue as well as bone structure. This synergistic involvement supports the training of the lumbar region, as the person stretches to reach the floor. Additionally, having the individual attempt to touch floor positions located at the center, to the front of center, and to the rear of center, involves different musculature, particularly the obliques. The soft tissue of the spinal column (e.g., muscles, ligaments, tendons, capsules) also becomes involved during these movements, and is arguably the greatest recipient of this training movement.

Figure 8:
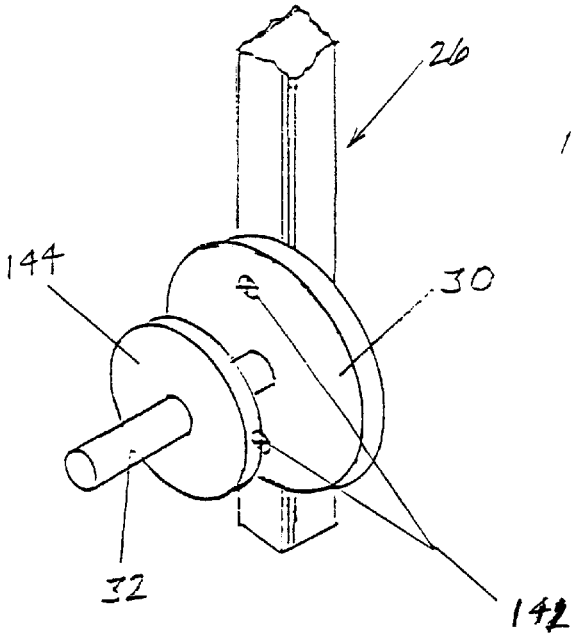
FIG. 8 is a perspective view of an alternative embodiment of a counterweight mounted on a resistance lever arm of the inventive pelvic rocker training apparatus.

The counterweight 30 shown in FIG. 1 is preferably a rectangular block weight, which is bolted to the first resistance lever arm 26. An alternative (and even more preferred) embodiment of the counterweight 30 is illustrated in FIG. 8, where the counterweight 30 is provided in the form of a disc shaped "barbell" weight, which is slipped over the rod 32 and preferably secured to the first resistance lever arm 26 by means of bolts 142. Also shown in FIG. 8, is an "additional weight" 144 that may be placed on the rod 32. When this additional weight 144 is added to counterbalance the upper torso weight of the user, it functions as a counterweight. The additional weight 144 may, however, be instead added to increase the resistance against the performed motion, in which case it functions as a stress weight.

Stress weight that is added to the first resistance lever arm 26 exerts a sinusoidal resistance beginning at zero when the resistance assembly 22 is in its rest position (with the first resistance lever arm 26 vertical). In contrast, weight that is added to the second resistance lever arm 28, while still exerting a sinusoidal resistance, begins at a point phase shifted on the sinusoidal curve by 80° (i.e., the magnitude of the angle $\alpha$). By applying additional stress weights selectively to either of the first and second resistance lever arms 26 and 28, respectively, the anatomical motion can be subjected to differing resistance curves.

Figure 9:
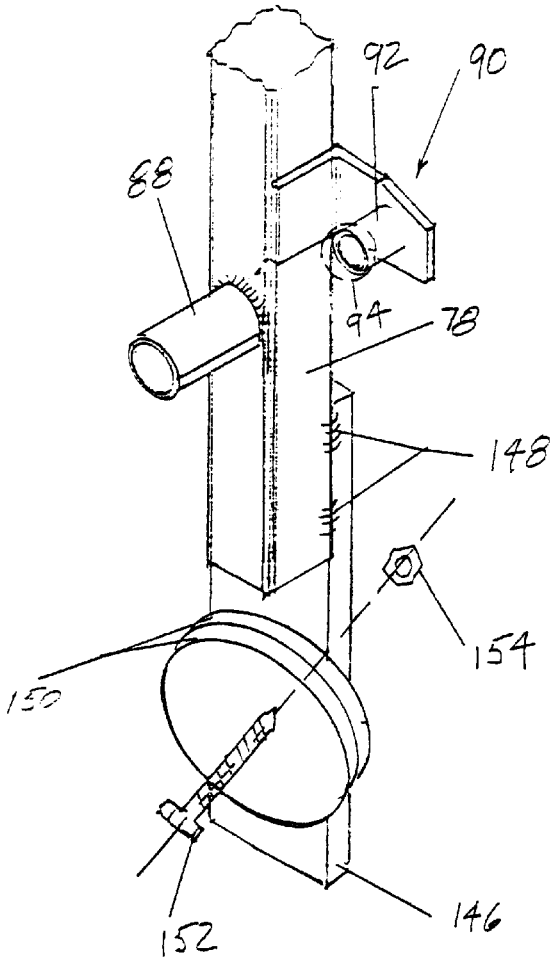
FIG. 9 is a perspective view of an alternative embodiment of a counterweight mounted on an exercise arm of the inventive pelvic rocker training apparatus.

FIG. 9 illustrates an alternative embodiment of the counterweight 68 for the exercise arm 20. The lower chamber portion 78 of the exercise arm 20 is shortened and a plate member 146 is affixed thereto (e.g., by welds 148). One or more "barbell" weights are secured to the plate member 146 via an elongated bolt 152 and nut 154.

Figure 10:
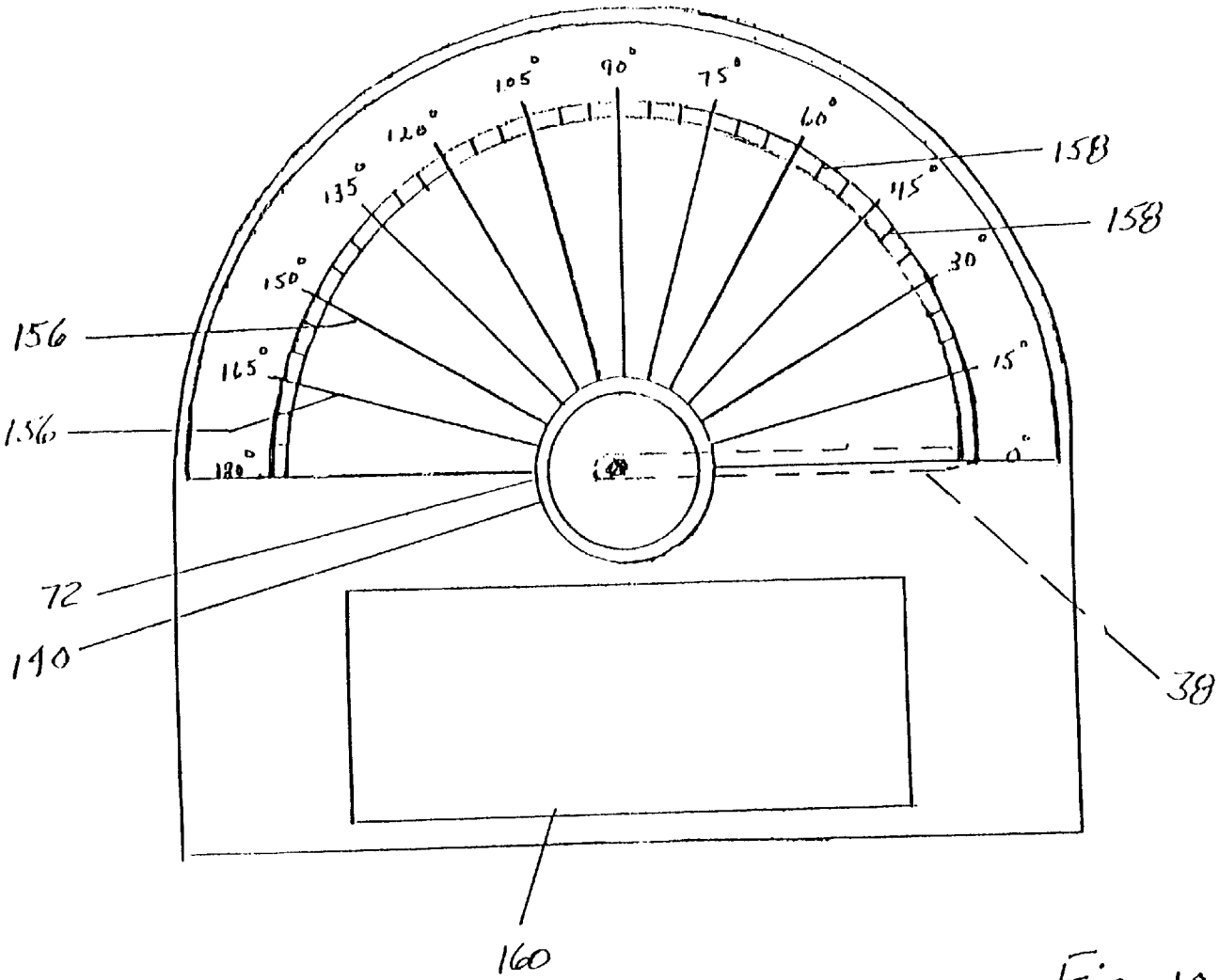
FIG. 10 is a plan view of a striated gauge member component of the inventive pelvic rocker training apparatus.

As seen in FIG. 10 (and as noted above), the striated gauge member 134 is preferably provided with radial markings 156 spaced at 15° intervals, and with additional subdivision markings 158 spaced at 5° intervals. The striated gauge member 134 may additionally be provided with a name/identification plate 160.

While the present invention has been disclosed by way of a detailed description of a number of particularly preferred embodiments, it will be clear to those of ordinary skill in the art that various substitutions of equivalents can be effected without departing from either the spirit or scope of the invention as set forth in the appended claims.

What is claimed is:

1. A training apparatus designed to improve the physical readiness level of the low back and pelvic girdle of an individual, said training apparatus comprising:

a frame;

a seat supported by said frame;

a pivot mechanism mounted on said frame and providing a pivot point disposed adjacent said seat;

an exercise arm extending outward from said pivot mechanism and rotatable about said pivot point; and a resistance assembly extending outward from said pivot mechanism and rotatable about said pivot point;

said exercise arm and said resistance assembly being linked to one another such that said exercise arm and said resistance assembly rotate as a single unit about said pivot point of said pivot mechanism;

said resistance assembly including a first resistance lever arm and a second resistance lever arm;

said first resistance lever arm including a counterweight;

said second resistance lever arm including a weight attachment mechanism for attaching a stress weight thereto; and said second resistance lever arm being angularly offset from said first resistance lever arm by an angle about said pivot point of said pivot mechanism.

2. A training apparatus according to claim 1, wherein:

said first resistance lever arm additionally includes a weight attachment mechanism for attachment of additional weight thereto; and said counterweight has a weight substantially sufficient to counterbalance an upper torso weight of an individual exerted on said exercise arm when such individual is seated in said seat and exerting such upper torso weight against said exercise arm.

3. A training apparatus according to claim 1, wherein said exercise arm and said resistance assembly are separately and non-integrally formed and wherein said training apparatus additionally comprises:

interlocking means for interlocking said exercise arm with said resistance assembly such that both of said exercise arm and said resistance assembly rotate as a single unit about said pivot point of said pivot mechanism.

4. A training apparatus according to claim 3, wherein said interlocking means includes:

a selective angular locking mechanism for locking said exercise arm with said resistance assembly at a selected one of a plurality of possible angular relationships between said exercise arm and said resistance assembly.

5. A training apparatus according to claim 4, wherein said selective angular locking mechanism includes:

a radial flange connected to said resistance assembly;

a plurality of apertures provided on said radial flange at a common radius from said pivot point; and a plunger mechanism provided on said exercise arm;

said plunger mechanism including a plunger rod for selectively engaging one of said plurality of apertures;

whereby said exercise arm and said resistance assembly can be selectively locked together at one of a plurality of relative angular dispositions.

6. A training apparatus according to claim 4, wherein:

said first resistance lever arm additionally includes a counterweight attached to said first resistance lever arm at a point distal from said pivot point of said pivot mechanism;

said counterweight having a weight substantially sufficient to counterbalance an upper torso weight of an individual exerted on said training arm when such individual is seated in said seat; and said selective angular locking mechanism provides means for adjusting the angular inclination of said exercise arm with respect to a vertical axis when said first resistance lever is in a substantially vertical inclination.

7. A training apparatus according to claim 1, wherein:

said pivot mechanism has an axis of rotation; and said exercise arm includes a torso contacting portion extending substantially parallel to said axis of rotation of said pivot mechanism;

said torso contacting portion extending substantially over said seat.

8. A training apparatus according to claim 5, wherein said training arm additionally includes:

torso contact adjustment means for selectively adjusting the distance of said torso contacting portion of said exercise arm from said pivot point of said pivot mechanism.

9. A training apparatus according to claim 1, said training apparatus additionally comprising:

a lumbar positioning device for contacting and positioning a lumbar region of an individual utilizing said training apparatus, said lumbar positioning device being disposed substantially immediately adjacent said seat.

10. A training apparatus according to claim 9, wherein said lumbar positioning device includes a lumbar bolster.

11. A training apparatus according to claim 10, wherein said lumbar positioning device additionally includes horizontal lumbar positioning adjustment means for selectively adjusting a substantially horizontal distance of said lumbar bolster with respect to said seat.

12. A training apparatus according to claim 10, wherein said lumbar positioning device additionally includes vertical lumbar positioning adjustment means for selectively adjusting a substantially vertical height of said lumbar bolster with respect to said seat.

13. A training apparatus according to claim 1, wherein:

said exercise arm extends across said pivot point of said pivot mechanism to form a further counterweight lever disposed on a side of said pivot point opposite said exercise arm; and said training apparatus additionally includes a further counterweight attached to said further counterweight lever on said opposite side of said pivot point from said exercise arm.

14. A training apparatus according to claim 1, said training apparatus additionally comprising:

a thigh engagement device for contacting and restraining an upper surface of a thigh of an individual utilizing said training apparatus.

15. A training apparatus according to claim 14, wherein said thigh engagement surface includes a thigh bolster for engaging and restraining such upper surface of such thigh of such individual utilizing said training apparatus.

16. A training apparatus according to claim 15, wherein said thigh engagement device additionally includes:

thigh engagement positioning means for selectively adjusting at least one of a height of said thigh bolster relative to said seat and a horizontal distance of said thigh bolster relative to said seat.

17. A training apparatus according to claim 1, said training apparatus additionally comprising:

a first connection member provided on said frame;

a second connection member provided on said resistance assembly; and at least one elastic resistance element extending between said first and second connection members;

said at least one elastic resistance element exerting a resistance to relative movement between said first and second connection members.

18. A training apparatus according to claim 17, wherein said at least one elastic resistance element includes a plurality of removable elastic resistance elements.

19. A training apparatus according to claim 5, said training apparatus additionally comprising:

a first connection member provided on said frame;

a second connection member provided on said radial flange; and at least one elastic resistance element extending between said first and second connection members;

said at least one elastic resistance element exerting a resistance to relative movement between said first and second connection members.

20. A training apparatus according to claim 1, wherein said pivot mechanism includes:

a first rotational bearing mounted on said frame and disposed to one side of said seat;

a second rotational bearing mounted on said frame and disposed between said first rotational bearing and said seat;

an axle extending between said first and second rotational bearings and rotatable therein;

and wherein:

said resistance assembly is fixedly attached to said axle to move therewith;

said exercise arm includes a tubular sleeve portion surrounding said axle and rotatable with respect thereto;

whereby said angular disposition between said training arm and said resistance assembly may be varied.

21. A training apparatus according to claim 1, said training apparatus additionally comprising:

an indicator member connected to said resistance assembly; and a striated gauge connected to said frame;

whereby movement of said resistance assembly relative to said frame is displayed by movement of said indicator member relative to said striated gauge.

22. A training apparatus according to claim 21, wherein said training apparatus additionally includes:

an indicator member connected to said axle; and a dial gauge connected to said frame and disposed adjacent said pointer member;

whereby movement of said resistance assembly relative to said frame is displayed by movement of said indicator member relative to said dial gauge.

23. A training apparatus according to claim 2, wherein:

said additional weight includes at least one of an additional counterweight and an additional stress weight.

24. A training apparatus designed to improve the physical readiness level of the low back and pelvic girdle of an individual, said training apparatus comprising:

a frame;

a seat supported by said frame;

a pivot mechanism mounted on said frame and providing a pivot point disposed adjacent said seat;

an exercise arm extending outward from said pivot mechanism and rotatable about said pivot point; and a resistance assembly extending outward from said pivot mechanism and rotatable about said pivot point;

said exercise arm and said resistance assembly being linked to one another such that said exercise arm and said resistance assembly rotate as a single unit about said pivot point of said pivot mechanism;

said resistance assembly including at least a first resistance lever arm;

said first resistance lever arm including a counterweight; and said counterweight having a weight substantially sufficient to counterbalance an upper torso weight of an individual exerted on said exercise arm when such individual is seated in said seat and exerting such upper torso weight against said exercise arm.

25. A training apparatus according to claim 24, wherein:

said first resistance arm additionally includes a weight attachment mechanism for attachment of additional weight thereto.

26. A training apparatus according to claim 24, wherein said exercise arm and said resistance assembly are separately and non-integrally formed and wherein said training apparatus additionally comprises:

interlocking means for interlocking said exercise arm with said resistance assembly such that both of said exercise arm and said resistance assembly rotate as a single unit about said pivot point of said pivot mechanism.

27. A training apparatus according to claim 26, wherein said interlocking means includes:

a selective angular locking mechanism for locking said exercise arm with said resistance assembly at a selected one of a plurality of possible angular relationships between said exercise arm and said resistance assembly.

* * * * *